US008839906B1

(12) United States Patent
Furr

(10) Patent No.: US 8,839,906 B1
(45) Date of Patent: Sep. 23, 2014

(54) ADJUSTABLE SPAN STABILIZER FOR LADDERS

(76) Inventor: Ricky Jason Furr, Bixby, OK (US)

( * ) Notice: Subject to any disclaimer, the term of this patent is extended or adjusted under 35 U.S.C. 154(b) by 111 days.

(21) Appl. No.: 13/317,804

(22) Filed: Oct. 28, 2011

(51) Int. Cl.
*E06C 7/06* (2006.01)

(52) U.S. Cl.
USPC ..... 182/107; 182/214

(58) Field of Classification Search
USPC ..... 182/107, 111, 116, 129, 206, 214; D25/68
See application file for complete search history.

(56) References Cited

U.S. PATENT DOCUMENTS

| | | | | |
|---|---|---|---|---|
| 4,502,566 | A | 3/1985 | Wing | |
| 5,113,973 | A | 5/1992 | Southern | |
| 5,121,814 | A | 6/1992 | Southern | |
| 5,242,031 | A * | 9/1993 | Ashley | 182/214 |
| 5,267,631 | A * | 12/1993 | Mendel | 182/107 |
| 5,855,252 | A | 1/1999 | Vrolyks | |
| 6,250,424 | B1 | 6/2001 | Laug | |
| 6,691,825 | B2 | 2/2004 | Haig | |
| 6,698,547 | B1 | 3/2004 | Uridel | |
| 6,851,518 | B1 * | 2/2005 | Walker | 182/107 |
| 6,959,785 | B1 * | 11/2005 | Chilton | 182/107 |
| 2003/0201139 | A1 | 10/2003 | Haig | |
| 2005/0023084 | A1 | 2/2005 | Lazarus | |

* cited by examiner

*Primary Examiner* — Katherine Mitchell
*Assistant Examiner* — Kristine Florio
(74) *Attorney, Agent, or Firm* — Frank J. Catalano

(57) ABSTRACT

An adjustable span ladder stabilizer has upper, middle and lower elongated tubes fixed in a height-wise stack with rear-most portions of the stack aligned on a planar contact surface for abutment against the ladder side rails. The upper and lower tubes telescope to vary the width of the stabilizer. Left and right elongated tubes extend in a depth-wise direction from the extending ends of their respective sliding tubes. The left and right tubes telescope to vary the depth of the stabilizer. A channel of C-shaped cross-section fixed to the rear face of the stack receives one of the ladder rungs between its flanges and a ratchet tie-down fixed to the front face of the stack tautly secures the stabilizer stack against the ladder side rails. The left and right sliding tubes can be inverted to permit the stabilizer to be rested against flat or corner walls.

17 Claims, 4 Drawing Sheets

ADJUSTABLE SPAN STABILIZER FOR LADDERS

BACKGROUND OF THE INVENTION

This invention relates generally to ladder accessories and more particularly concerns an adjustable span stabilizer for use with ladders of various structural configurations.

Typical ladders consist of a pair of side rails spaced apart by a plurality of rungs. The side rails are commonly of tubular or channel-shaped cross-section with the narrower walls extended along the front and rear surfaces of the rails. The ladder width is generally in a range of 18 to 24 inches. The upper ends of the ladder rails are usually leaned into contact with the supporting surface to position the ladder for use. Often, the supporting surface does not have rail-end resting points for which are suitably spaced to allow positioning of the ladder in a most convenient location in relation to the work to be performed. For example, in exterior building applications, windows, chimneys, roof angles, dormers, building corners and other variations from flat wall conditions can make convenient and stable positioning of the ladder a difficult, and sometimes impossible, task.

In response to this problem, a number of spacing devices have been conceived to adapt the ladder to the supporting surface. Some of them connect to the over the upper ends of the rails and, therefore, can be used only on the very upper end of the ladder. Others connect between two rails, so they can be used at different elevations on the ladder but interfere with other use for the supporting rungs. Some use a single width-wise fixed tube which telescopes to the left and right, but this severely limits the total spanning width that can be achieved and may also compromise the strength of the device. Most are so complex that it is difficult to adjust the position of the device along the height of the ladder and to adjust the width of the span and/or the depth of the device in relation to the supporting surface.

It is, therefore, an object of this invention to provide a stabilizer for ladders which is capable of adjustment to span relatively wide obstacles on the ladder supporting surface. Another object of this invention is to provide a stabilizer for ladders which is capable of adjustment to accommodate corner surface applications. Still another object of this invention is to provide a stabilizer for ladders which can be mounted at different heights of the ladder. A further object of this invention is to provide a stabilizer for ladders which does not slide over the upper ends of the ladder side rails. Yet another object of this invention to is provide a stabilizer for ladders which requires use of only one rung of the ladder to secure the height of the stabilizer on the ladder. It is also an object of this invention to provide a stabilizer for ladders which can be easily repositioned at different heights on the ladder. Another object of this invention is to provide a stabilizer for ladders which can be easily adjusted to vary its span. And it is an object of this invention to provide a stabilizer for ladders which can be easily adjusted to vary its spacing from the ladder supporting surface.

SUMMARY OF THE INVENTION

In accordance with the invention an adjustable span stabilizer is provided for use with ladders. The basic components of ladders generally are a pair of side rails spaced apart by a plurality of rungs. The stabilizer has upper, middle and lower elongated tubes extending in a width-wise direction and fixed in a height-wise stack. The rearmost portions of the stack are aligned to define a planar contact surface which can be butted against the forward faces of the ladder side rails. The width of the stack is preferably greater than the width of the ladder. Upper and lower elongated tubes are slidably disposed in the fixed upper and lower tubes of the stack. One sliding tube has an end which extends from one end of the stack. The other sliding tube has an end which extends from the other end of the stack. Thus, the width of the stabilizer can be varied to the left and/or right of the stack. Left and right elongated tubes are fixed to the extending ends of their respective upper and lower sliding tubes. The left and right tubes extend in a depth-wise direction and are aligned on a common horizontal plane in line with the middle elongated tube of the stack. Left and right elongated tubes are slidably disposed in the left and right fixed tubes. The sliding tubes extend forwardly from their respective fixed tubes. Thus, the depth of the stabilizer can be varied on the left and/or right sides of the stack. Each pair of fixed and sliding tubes can be locked in one of at least two, and preferably at a plurality of equal, displacement positions. Locking is preferably accomplished by use of at least one hole through a wall of one tube of each pair of tubes and at least two holes through a wall of the other tube of each pair of tubes with at least one pin insertable into aligned ones of the holes.

The tubes are preferably of orthogonal cross-section and most preferably of square cross-section. It is also preferred that the upper and lower sliding tubes are longer than their respective fixed tubes and most preferably sufficiently long to permit substantial widening of the stabilizer without drawing the trailing end of the sliding tube past the trailing end of its fixed tube. Similarly, it is preferred that the left and right sliding tubes are longer than their respective fixed tubes and most preferably sufficiently long to permit substantial depth-wise extension of the stabilizer without drawing the trailing end of the sliding tube past the trailing end of its fixed tube.

To mount the stack on the ladder, a channel of C-shaped cross-section has its web fixed to a rear face of the stack. The flanges of the channel have a width which can be inserted between the ladder side rails and a depth and spacing to receive one of the ladder rungs between the flanges. The planar contact surface of the stabilizer is clamped in abutment against the side rails of the ladder by use of a ratchet tie-down fixed to the front face of the stack. A pair of openings through the fixed middle member are oriented on opposite sides of the tie-down and extend toward their respective side rails of the ladder. The openings receive the free end of a belt having another end fixed to the tie-down through one of the openings, around one of the side rails, across the ladder, around the other of the side rails and into engagement with the ratcheted shaft of the tie-down. The tie-down is ratcheted to tautly secure the stabilizer stack against the ladder side rails.

In one embodiment, the stabilizer left and right sliding tubes have end portions which extend toward a point of convergence, preferably the angle of convergence between the end portions being 90 degrees. With the depth-wise portions of the sliding tubes extending forwardly from their respective fixed tubes, the stabilizer can be rested against a flat wall. With the converging portions of the sliding tubes extending forwardly from their respective fixed tubes, the stabilizer can be rested against corner walls.

Pads may be provided for abutment with the surface against which the ladder will be supported. Preferably, the pads are pivotally attached to the forward ends of the left and right sliding tubes to permit angular displacement of the pads into abutment with the ladder supporting surface. Most preferably, the left and right sliding tubes have depth-wise portions and angled portions and the pads have adapters which permit them to be attached to either free end of their respective sliding tube.

BRIEF DESCRIPTION OF THE DRAWINGS

Other objects and advantages of the invention will become apparent upon reading the following detailed description and upon reference to the drawings in which.

While the invention will be described in connection with a preferred embodiment thereof, it is not intended to limit the invention to those embodiments or to the details of the construction or arrangement of its parts illustrated in the accompanying drawings.

DETAILED DESCRIPTION

Figure 1C:
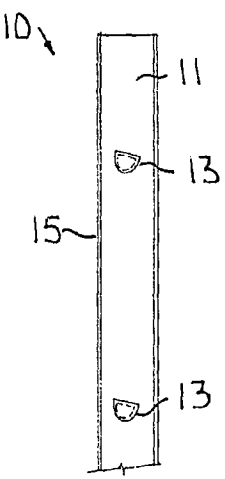
FIG. 1C is a left side elevation view of the ladder of FIG. 1A.
Figure 1B:
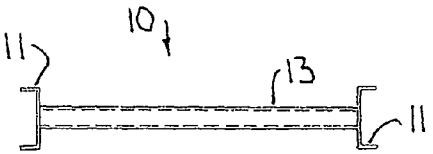
FIG. 1B is a top plan view of the ladder of FIG. 1A.
Figure 1A:
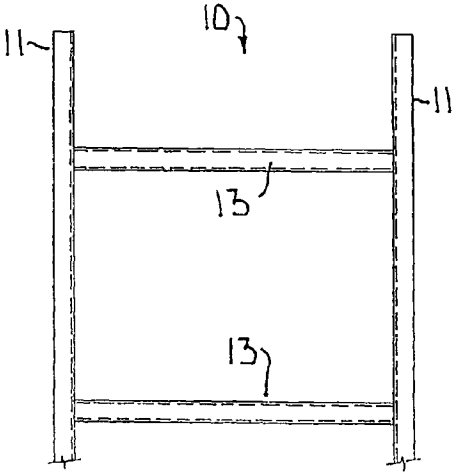
FIG. 1A is a rear elevation view of a typical ladder for use with the ladder stabilizer of the present invention.
Figure 5:
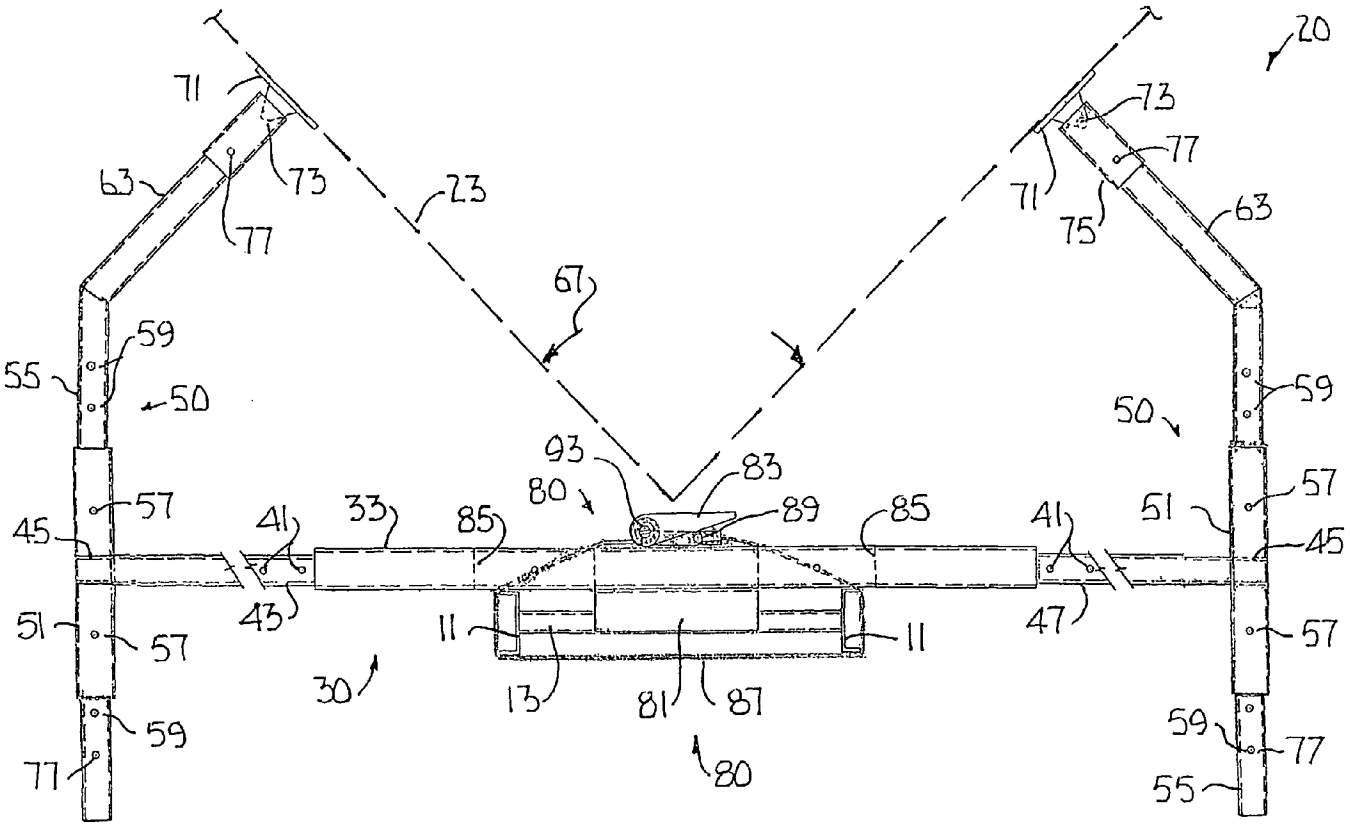
FIG. 5 is a top plan view of a preferred embodiment of the ladder stabilizer mounted on the ladder of FIG. 1A with its depth-wise sliding tubes in a corner-supported configuration.

Turning first to FIGS. 1A, 1B and 1C, a typical ladder 10, that is a ladder with side rails 11 spaced apart by a plurality of rungs 13, is illustrated. Looking at FIGS. 2A, 2B and 2C, an adjustable span stabilizer 20 for use in adapting such a ladder 10 to the configuration of the surface against which the ladder 10 is to be leaned is illustrated. Such surfaces, for example, may be flat walls 21 as seen in FIG. 2B or corners 23 as seen in FIG. 5 or may involve irregular surfaces such as windows, doors, dormers, vents or any structural variation. The stabilizer 20 facilitates spanning a portion of the surface, such as a window pane, to avoid contacting it with either or both of the ladder rails 11. The stabilizer 20 also facilitates spacing the ladder rails 11 at different distances from non-coplanar supporting surfaces so as to keep the rungs 13 of the ladder 10 parallel to the supporting surfaces.

Figure 2C:
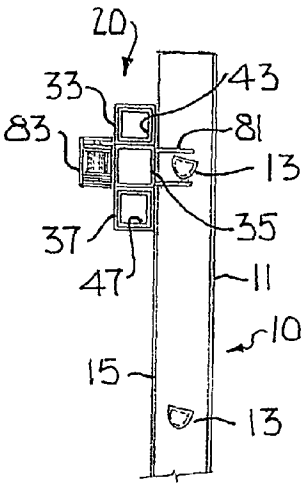
FIG. 2C is a left side elevation view of the ladder stabilizer of FIG. 2A mounted on the ladder of FIG. 1A.
Figures 2A, 2B:
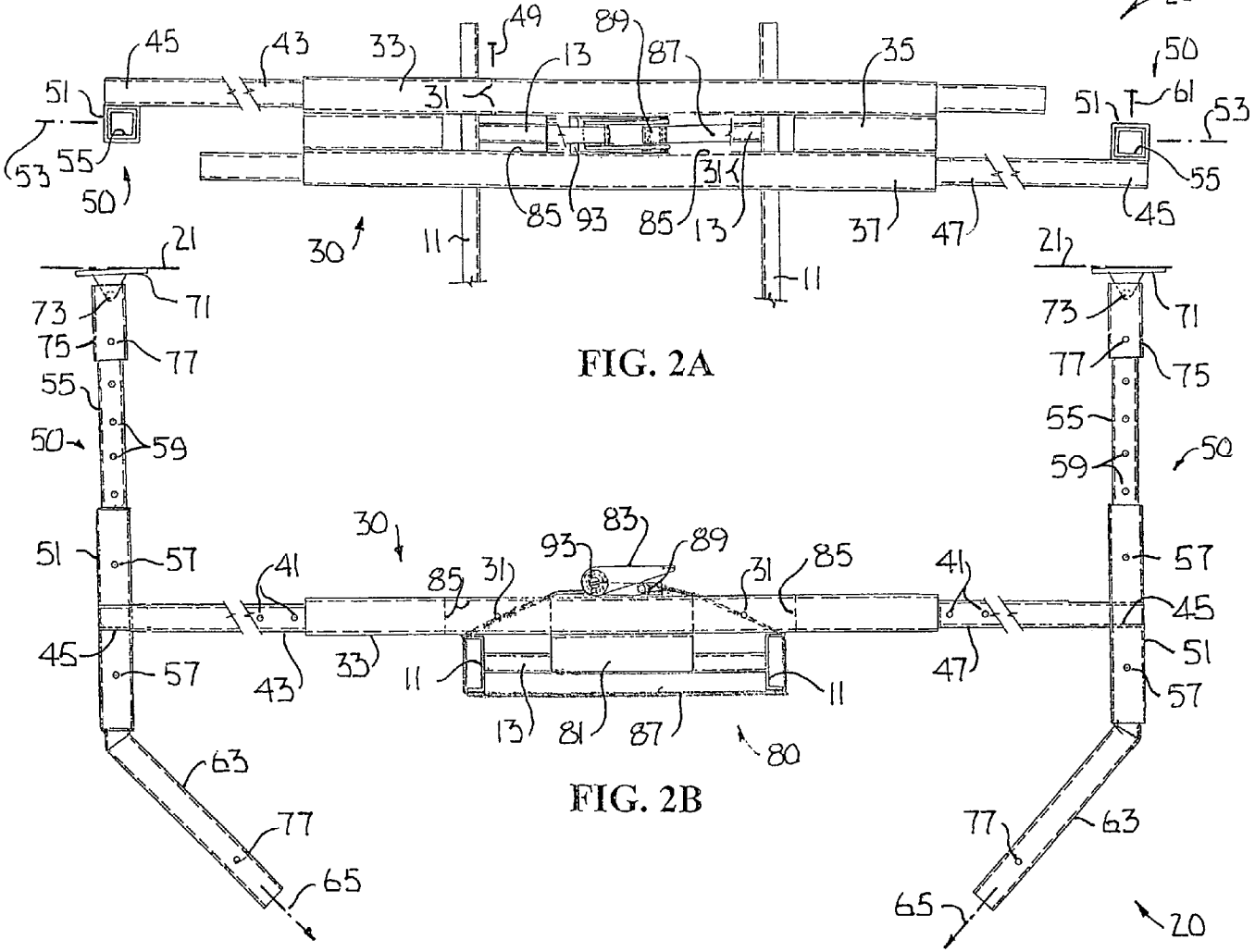
FIG. 2A is a rear elevation view of a preferred embodiment of the ladder stabilizer mounted on the ladder of FIG. 1A with its depth-wise sliding tubes in a wall-supported configuration.
FIG. 2B is a top plan view of the ladder stabilizer of FIG. 2A mounted on the ladder of FIG. 1A.

As seen in FIGS. 2A, 2B and 2C, the stabilizer 20 has an adjustable width-wise extension assembly 30 for varying the spanning width of the ladder 10, adjustable depth-wise extension assemblies 50 on the ends of the width-wise extension assembly 30 for independently varying the spacing between the ladder rails 11 and their respective supporting surfaces and a clamping assembly 80 for securing the width-wise extension assembly 30 in abutment against the side rails 11 of the ladder 10.

Figure 3A:
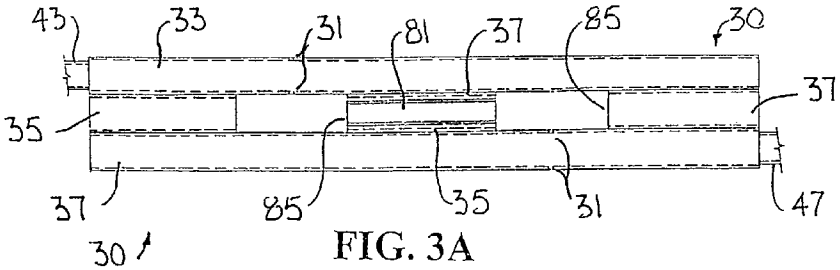
FIG. 3A is a front elevation view of the width-wise fixed tube stack of the ladder stabilizer of FIG. 2A.
Figure 3B:
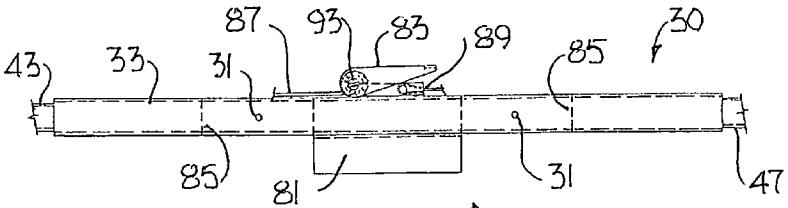
FIG. 3B is a top plan view of the stack of FIG. 3A.
Figure 3C:
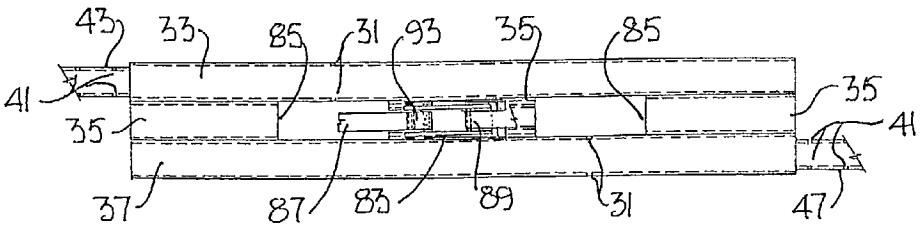
FIG. 3C is a rear elevation view of the stack of FIG. 3A.

As best seen in FIGS. 3A, 3B and 3C, the preferred adjustable width-wise extension assembly 30 has upper 33, middle 35 and lower 37 elongated tubes which extend in the width-wise direction and are fixed in a height-wise stack. The rearmost portions of this preferred assembly 30, as best seen in FIG. 2C, define a planar surface 39 for contacting the forward surfaces 15 of the ladder side rails 11, which are also coplanar. Returning to FIGS. 3A, 3B and 3C, upper 43 and lower 47 elongated tubes are slidably disposed in their respective fixed upper 33 and lower 37 tubes. One of the sliding tubes 43 or 47 has an end 45 extending from one end of the stack and the other of the sliding tubes 47 or 43 has an end 45 extending from the other end of the stack, so that the width of the assembly 30 can be extended or shortened on either or both sides of the width-wise assembly 30. As shown, all of the tubes 33, 35, 37, 43 and 47 of the width-wise extension assembly 30 are of square cross-section. The square cross-sections prevent rotation of the telescoping tubes 43 and 47 in their fixed tubes 33 and 37, afford flexibility in the interchange and orientation of the sliding tubes 43 and 47 in their fixed tubes 33 and 37 and provide the greatest coplanar surface area 39 for abutment with the ladder rails 11. However, the middle elongated tube 35 could be omitted and the upper tube 33 stacked directly on the lower tube 37. The tubes 33, 35, 37, 43 and 47 could be of any cross-section, whether orthogonal, non-circular or circular with a key-way, as long as the configuration restricts rotation of a telescoping tube 43 or 47 in its guide or fixed tube 33 or 37 and provides sufficient rearmost surface portion to afford a suitable coplanar surface 39 for abutment against the coplanar forward surfaces 15 of the ladder rails 11. As shown in FIGS. 2A and 2B, the fixed upper 33 and lower 37 tubes each have a hole 31 through their wall and the sliding tubes 43 and 47 each have at least two holes 41 through their walls so that a pin 49 can be inserted into aligned ones of the holes 31 and 41 to lock the sliding tubes 43 and 47 at the desired width of the assembly 30. Each pin 49 can extend through one pair of mating holes 31 and 41 in its associated fixed 33 or 37 and sliding 43 or 47 tubes, may extend through two pairs of mating holes 31 and 41 in its associated fixed 33 or 37 and sliding 43 and 47 tubes or may extend through pairs of mating holes 31 and 41 in both associated fixed 33 and 37 and sliding 43 and 47 tubes. As best seen in FIG. 2A, the preferred width-wise assembly 30 has upper 43 and lower 47 sliding tubes which are longer than their respective fixed tubes 33 and 37. This permits substantial width extension while maintaining substantial overlap of the fixed 33 or 37 and sliding 43 or 47 tubes. Preferably, the length of the sliding tubes 43 and 47 is selected, and the holes 31 and 43 through the tubes 33 and 37 and 43 and 47 are arranged, so that at maximum extension the sliding tubes 43 and 47 extend approximately fully through their fixed tubes 33 and 37. This further accommodates the use of pins 49 which extend through both pairs of fixed 33 and 37 and sliding 43 and 47 tubes. The sliding tubes 43 and 47 need not be longer than the fixed tubes 33 and 37, but this would significantly limit the maximum extension of the width-wise assembly 30. Of course, a single hole 31 could be provided in the sliding width-wise tubes 43 and 47 and multiple holes 41 in the fixed width-wise tubes 33 and 37.

Figure 4A:
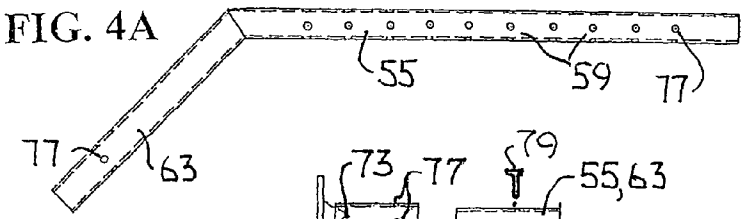
FIG. 4A is a top plan view of a typical depth-wise sliding tube of the ladder stabilizer of FIG. 2A.
Figure 4B:
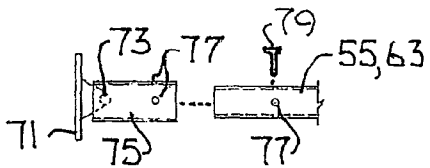
FIG. 4B is a top plan view of a typical wall adapter for use on either end of the depth-wise sliding tube of FIG. 4A.

Looking at FIGS. 2A, 2B, 2C, and 4A, each preferred adjustable depth-wise extension assembly 50 has an elongated tube 51 extending in the depth-wise direction and fixed to the extending end 45 of its respective upper 43 or lower 47 sliding tube of the width-wise assembly 30. Preferably, the fixed tubes 51 are at least approximately aligned on a common plane 53. To this end and as shown, the left fixed depth-wise tube 51 is fixed to the bottom of the left end 45 of the left extending width-wise sliding tube 43. Similarly, the right fixed depth-wise tube 51 is fixed to the top of the right end 45 of the right extending width-wise sliding tube 47. This arrangement could be reversed or even modified to accommodate different embodiments of the stabilizer 20. For example, if the middle width-wise tube 35 is not used, the fixed depth-wise tubes 51 could be welded to the vertical end faces of the sliding width-wise tubes 43 and 47. Left and right elongated tubes 55 are slidably disposed in the left and right fixed depth-wise tubes 51, respectively, and extend forwardly from their respective fixed depth-wise tubes 51. As shown, all of the tubes 51 and 55 of the depth-wise extension assemblies 50 are of square cross-section. The square cross-sections prevent rotation of the telescoping tubes 55 in their fixed tubes 51 and afford flexibility in the interchange and orientation of the sliding tubes 55 in their fixed tubes 51. However, the tubes 51 and 55 could be of any cross-section, whether orthogonal, non-circular or circular with a key-way, as long as the configuration restricts rotation of a telescoping tube 55 in its guide or fixed tube 51. As shown in FIG. 2B, the fixed depth-wise tubes 51 extend forwardly and rearwardly from their respective sliding width-wise tubes 43 and 47. Each fixed depth-wise tube 51 has a hole 57 through its wall and each sliding depth-wise tube 55 has at least two holes 59 through its walls so that a pin 61 can be inserted into aligned ones of the holes 57 and 59 to lock the sliding depth-wise tubes 55 at the desired depths of these assemblies 50. Each pin 61 can extend through one pair of mating holes 57 and 59 in its associated fixed and sliding depth-wise tubes 51 and 55 or may extend through two pairs of mating holes 57 and 59 in its associated fixed and sliding depth-wise tubes 51 and 55. As best seen in FIG. 2B, the preferred depth-wise sliding tube 55 shown is longer than its respective fixed tube 51. This permits substantial depth extension while maintaining substantial overlap of the fixed and sliding depth-wise tubes 51 and 55. Preferably, the length of the sliding depth-wise tubes 55 is selected, and the holes 57 and 59 through the tubes 51 and 55 are arranged, so that at maximum extension the sliding depth-wise tubes 55 extend approximately fully through their fixed depth-wise tubes 51. The sliding depth-wise tubes 55 need not be longer than the fixed depth-wise tubes 51, but this would significantly limit the maximum extension of the depth of each depth-wise assembly 50. As best seen in FIGS. 2B and 4A, the rear end portions 63 of the left and right sliding depth-wise tubes 55 may extend toward a point of convergence 65, as shown to a point of convergence 65 at which the angle 67 between said end portions 63 is approximately 90 degrees. Thus, if the forward ends of the sliding depth-wise tubes 55 are inserted through the rear ends of the fixed depth-wise tubes 51, the stabilizer 20 is configured for use against a flat wall 21, as seen in FIG. 2B. However, if the forward ends of the sliding depth-wise tubes 55 are inserted through the front ends of the fixed depth-wise tubes 51, the stabilizer 20 is configured for use against a corner 23, as seen in FIG. 5. Of course, a single hole 57 could be provided in the sliding depth-wise tubes 55 and multiple holes 59 in the fixed depth-wise tubes 51.

Looking at FIGS. 2B, 4A, 4B and 5, in order to provide a conformed adherence of the stabilizer 20 to the supporting surfaces, the depth-wise assemblies 50 may include pads 71 mounted on the forwardly extended ends of the depth-wise sliding tubes 55 for abutment against the surfaces on which the ladder 10 is to be supported. As shown, the pads 71 and the sliding depth-wise tubes 55 are adapted to permit attachment of a pad 71 to either free end of its respective sliding depth-wise tube 55. The pads 71 are pivotally mounted on shafts 73 extending through tubular sleeves 75 which can be slidably engaged on the ends of the sliding depth-wise tubes 55, permitting angular displacement of the pads 71 into abutment with the supporting surfaces. Mating holes 77 in the tubes 55 and sleeves 75 receive locking pins 79 to secure the pads 71 in place on the sliding depth-wise tubes 55. If the tubes 55 and sleeves 75 are square as shown and holes 77 are provided in each of the four tube walls, the angled portions 63 of the sliding depth-wise tubes 55 can be directed inwardly, outwardly, upwardly or downwardly, depending on the specific job to be performed or the personal preferences of the user.

Looking at FIGS. 2A, 2B, 2C, 3A, 3B and 3C, the clamping assembly 80 has a channel 81 of C-shaped cross-section with its web fixed to the rear face of the stack of width-wise tubes 33, 35 and 37, as shown to the middle tube 35. As best seen in FIGS. 2B and 2C, the channel flanges are of width suitable for insertion between the side rails 11 of the ladder 10 and of depth and spacing suitable to receive a rung 13 of the ladder 10 in the channel 81. As shown, the width of the stack of width-wise tubes 33, 35 and 37 is greater than the width of the ladder 10, so that the width-wise assembly 30 can be abutted against the front faces 15 of the ladder rails 11 with a ladder rung 13 received in the channel 81. The clamping assembly 80 also has a ratchet tie-down 83 fixed to a front face of the stack of width-wise tubes 33, 35 and 37, as shown to the middle tube 35. A pair of openings 85 through the fixed middle tube 35 are oriented on opposite sides of the tie-down 83 and extend toward their respective side rails 11 of the ladder 10. The openings 85 receive the tie-down belt 87 which is fixed at one end 89 to the tie-down 83. As best seen in FIG. 2B, the free end 91 of the belt 87 extends through one of the openings 85, around one of the side rails 11, across the ladder 10, around the other of the side rails 11 and to a ratcheted shaft 93 of the tie-down 83. To secure the stabilizer 20 to the ladder rails 11 at any rung 13 of the ladder 10, the user need only release the ratcheted end 91 of the belt 87, slide the stabilizer 20 to receive the selected rung 13 and operate the ratchet 83 to pull the belt 87 taut around the ladder 10.

As shown, the width-wise assembly 30 is abutted to the ladder rails 11 with the depth-wise tubes 51 and 55 oriented perpendicular to the plane of the front faces 15 of the ladder 10. "Horizontal" as used herein is in reference to a ladder 10 which is vertically aligned. If the ladder 10 is leaned against a supporting surface, the ladder 10 is not truly vertical and the depth-wise tubes 51 and 55 are not truly "horizontal." The pivotal pads 71 help to accommodate this deviation. However, the abutting surface 39 of the width-wise assembly 30 may be adapted with an angular shim or the like (not shown) if it is desired that the depth-wise tubes 51 and 55 be truly horizontal when the ladder 10 is in a leaning condition.

A typical stabilizer made with approximately 2" square steel tubing, the fixed and sliding tubes being of coordinated cross-sections, will have a width wise span variable from approximately 3' to 7' and a depth-wise extension variable from approximately 1.5° to 3'. These dimensions may vary considerably, depending on the selected cross-sections and thicknesses of tubing, and the strength of any stabilizer, regardless of choice of materials and dimensions should be tested for desirable protocols before use.

It is, therefore, apparent that there has been provided, in accordance with the invention, an adjustable-span stabilizer for ladders that fully satisfies the objects, aims and advantages set forth above. While the invention has been described in conjunction with a specific embodiment thereof, many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For use with ladders having side rails spaced by a plurality of rungs, a stabilizer comprising:

fixed upper, middle and lower elongated tubes extending in a width-wise direction and in a height-wise stack having rearmost portions defining a planar contact surface;

sliding upper and lower elongated tubes disposed in said fixed upper and lower tubes, respectively, one of said sliding tubes having an end extending from one end of said stack and the other of said sliding tubes having an end extending from another end of said stack;

fixed left and right elongated tubes extending in a depth-wise direction, said left and right tubes being fixed to said extending ends of their respective said sliding upper and lower elongated tubes;

sliding left and right elongated tubes disposed in said fixed left and right elongated tubes, respectively, and extending forwardly therefrom; and means for locking each pair of said fixed and sliding tubes in one of at least two displacement positions.

2. For use with ladders having side rails spaced by a plurality of rungs, a stabilizer comprising:

fixed upper and lower elongated tubes extending in a width-wise direction and in a height-wise stack having rearmost portions defining a planar contact surface;

sliding upper and lower elongated tubes disposed in said fixed upper and lower tubes, respectively, one of said sliding tubes having an end extending from one end of said stack and the other of said sliding tubes having an end extending from another end of said stack;

fixed left and right elongated tubes extending in a depth-wise direction, said left and right tubes being fixed to said extending ends of their respective said sliding upper and lower elongated tubes;

sliding left and right elongated tubes disposed in said fixed left and right elongated tubes, respectively, and extending forwardly therefrom;

means for locking each pair of said fixed and sliding tubes in one of at least two displacement positions; and means for clamping said planar contact surface in abutment against the side rails of the ladder.

3. For use with ladders having side rails spaced by a plurality of rungs, a stabilizer comprising:

fixed upper, middle and lower elongated tubes extending in a width-wise direction and in a height-wise stack having rearmost portions defining a planar contact surface;

sliding upper and lower elongated tubes disposed in said fixed upper and lower elongated tubes, respectively, one of said sliding tubes having an end extending from one end of said stack and the other of said sliding tubes having an end extending from another end of said stack;

fixed left and right elongated tubes extending in a depth-wise direction and aligned on a common horizontal plane, said fixed left and right elongated tubes being fixed to said extending ends of their respective said sliding upper and lower elongated tubes;

sliding left and right elongated tubes disposed in said fixed left and right elongated tubes, respectively, and extending forwardly therefrom; and means for locking each pair of said fixed and sliding elongated tubes in one of at least two displacement positions.

4. A stabilizer according to claim 3, each said locking means comprising:

at least one hole through a wall of one tube of each said pair of tubes;

at least two holes through a wall of another tube of each said pair of tubes; and at least one pin insertable into aligned ones of said holes.

5. A stabilizer according to claim 3, said tubes being of orthogonal cross-section.

6. A stabilizer according to claim 5, said tubes being of square cross-section.

7. A stabilizer according to claim 3, said sliding upper and lower elongated tubes being longer than their respective said fixed upper and lower elongated tubes.

8. A stabilizer according to claim 3, said sliding left and right elongated tubes being longer than their respective said fixed left and right elongated tubes.

9. A stabilizer according to claim 3 further comprising a channel of C-shaped cross-section having a web thereof fixed to a rear face of said stack and flanges of width to be inserted between the side rails and of depth and spacing to receive a rung of the ladder therebetween.

10. A stabilizer according to claim 3, said sliding left and right elongated tubes having end portions extending toward a point of convergence.

11. A stabilizer according to claim 10, an angle between said end portions being 90 degrees.

12. A stabilizer according to claim 3 further comprising:

pads for abutment with a surface against which the ladder is to be supported; and means pivotally attaching said pads to forward ends of said sliding left and right elongated tubes for permitting angular displacement of said pads into abutment with the supporting surface.

13. A stabilizer according to claim 12, said sliding left and right elongated tubes having depth-wise portions and angled portions extending toward a point of convergence, said depth-wise and angled portions having free ends and said attaching means being adapted to permit attachment of a pad to either said free end of its respective said sliding tube.

14. A stabilizer according to claim 3, a width of said stack being greater than a width of the ladder.

15. A stabilizer according to claim 14 further comprising means for clamping said planar contact surface in abutment against the side rails of the ladder.

16. A stabilizer according to claim 15, said clamping means comprising:

a ratchet tie-down fixed to a front face of said stack;

a pair of openings through said fixed middle member, said openings being oriented on opposite sides of said tie-down and extending toward their respective side rails of the ladder for receiving a belt having one end thereof fixed to said tie-down and another end thereof extending through one of said openings, around one of the side rails, across the ladder, around the other of the side rails and to a ratcheted shaft of said tie-down.

17. A stabilizer according to claim 16 further comprising a channel of C-shaped cross-section having a web thereof fixed to a rear face of said stack and flanges of width to be inserted between the side rails and of depth and spacing to receive a rung of the ladder therebetween.

* * * * *